US005772150A

United States Patent [19]

Spatafora

[11] Patent Number: 5,772,150

[45] Date of Patent: Jun. 30, 1998

[54] REEL CHANGE DEVICE FOR FEED DEVICES SUPPLYING STRIP MATERIAL TO A USER MACHINE

[75] Inventor: Mario Spatafora, Bologna, Italy

[73] Assignee: Azionaria Costruzioni Macchine Automatiche A.C.M.A. S.p.A., Bologna, Italy

[21] Appl. No.: 683,046

[22] Filed: Jul. 15, 1996

Related U.S. Application Data

[63] Continuation of Ser. No. 224,326, Apr. 7, 1994, abandoned.

[30] Foreign Application Priority Data

Apr. 9, 1993 [IT] Italy ..... BO93A0141

[51] Int. Cl.[6] ..... B65H 19/14

[52] U.S. Cl. ..... 242/554.1; 242/554.6; 242/556.1; 156/504

[58] Field of Search ..... 242/554.1, 554.2, 242/554.6, 556.1; 156/502, 504

[56] References Cited

U.S. PATENT DOCUMENTS

| | | | |
|---|---|---|---|
| 2,745,464 | 5/1956 | Auerbacher et al. | 242/556.1 X |
| 3,948,715 | 4/1976 | Tokuno | 242/554.2 X |
| 4,097,323 | 6/1978 | De Roeck et al. | 242/556.1 X |
| 4,169,752 | 10/1979 | Tokuno | 242/556.1 X |
| 4,278,489 | 7/1981 | Horsley | 242/556.1 X |
| 4,450,039 | 5/1984 | Salvucci et al. | 156/504 |
| 4,492,609 | 1/1985 | Blom | 242/554.6 X |
| 4,506,842 | 3/1985 | Beck | 242/554.6 X |
| 4,564,150 | 1/1986 | Keene et al. | 242/556.1 X |
| 4,720,320 | 1/1988 | Niemi | 156/504 |
| 4,880,178 | 11/1989 | Goulette | 242/556.1 X |
| 4,881,695 | 11/1989 | Beisswanger | 242/556.1 |
| 5,252,170 | 10/1993 | Schaupp | 156/504 X |
| 5,253,819 | 10/1993 | Butler, Jr. | 242/554.6 |

FOREIGN PATENT DOCUMENTS

| | | |
|---|---|---|
| 2453095 | 10/1980 | France . |
| 513066 | 2/1971 | Switzerland . |
| 2243599 | 6/1991 | United Kingdom . |

*Primary Examiner*—Donald P. Walsh
*Assistant Examiner*—William A. Rivera
*Attorney, Agent, or Firm*—Ladas & Parry

[57] ABSTRACT

A reel change device whereby a first strip, unwound off a runout reel, and a second strip, unwound off a new reel, are fed along an S-shaped path defined by two adjacent suction conveyor rollers with selectively-activated suction devices; the speed and timing of the strips are synchronized; the strips are then cut simultaneously along a first portion of the path, defined by the first roller, and are connected end-to-end as they travel at constant speed along a second portion of the path; and the cut-off portion of the second strip is fed by the first roller to a disposal container.

9 Claims, 5 Drawing Sheets

1
3a
3b
7a
7b
8
20
21
22
23
24
25
26
27
28
31
32
33
34
35
36
37
38
39
40
41
42
43
44
45
46
47
48
49
50
51
52
53
54
55
56
57
58
59
60
61
62
62a
63
64
65
66
67
68
69
70
71
72
73
74

1
3a
3b
7a
7b
8
20
21
22
23
24
25
26
27
28
31
32
33
34
35
36
37
38
39
40
41
42
43
44
45
46
47
48
49
50
51
52
53
54
55
56
57
58
59
60
61
62
62a
63
64
65
66
67
68
69
70
71
72
73

REEL CHANGE DEVICE FOR FEED DEVICES SUPPLYING STRIP MATERIAL TO A USER MACHINE

This application is a continuation of application Ser. No. 08/224,326 filed on Apr. 7, 1994 now abandoned.

BACKGROUND OF THE INVENTION

The present invention relates to a reel change device for feed devices supplying strip material to a user machine.

In particular, the present invention relates to a reel change device whereby the trailing end of a first strip unwound off a runout reel is spliced substantially automatically, and without stopping the machine, to the leading end of a second strip unwound off a new reel.

Known reel change devices of the aforementioned type can be divided substantially into two categories: a first comprising devices whereby the two strips are spliced, end to end or in overlapping manner, by stopping the first strip inside a splicing station; and the second comprising devices such as the one described in U.S. Pat. No. 4,415,127, whereby the two strips are spliced without being stopped.

Devices of the first type are invariably of considerable size, mainly due to the presence of cumbersome compensating stores for storing a certain amount of the first strip for use by the machine during the splicing operation.

On the other hand, a typical drawback of devices of the second type is that they fail to provide, simply and relatively cheaply, for accurate butt splicing, thus resulting in a certain amount of waste strip material on the machine.

SUMMARY OF THE INVENTION

It is an object of the present invention to provide a straightforward, low-cost reel change device, in particular of the second type described above, for accurately splicing the two strips end to end.

According to the present invention, there is provided a reel change device for feed devices supplying strip material to a user machine; the reel change device comprising a first and second unwinding station for a first and second reel of respectively first and second strip material; means defining a path along which the strip material is fed in a given unwinding direction; and cutting means and splicing means located along said path, for cutting and splicing the strip material; characterized by the fact that it also comprises a first and second conveyor in series with each other, the first upstream from the second in said unwinding direction, and adjacent to each other at a transfer station at which the strip material is transferred from the first to the second conveyor, the conveyors respectively defining a first and second portion of said path; strip material disposal means at the transfer station; and first and second selectively-activated retaining means arranged in series along said path, for respectively retaining the strip material on the first and second conveyor; the cutting means and splicing means being located along said path along the first and second conveyor respectively.

According to a preferred embodiment of the above device, said path comprises a bend at said transfer station; said first and second unwinding stations being so located, in relation to said first portion of the path, as to enable the first strip material to be positioned, in use, between the first retaining means and the second strip material.

The above device preferably also comprises first and second drive means for said first and second conveyors; the second drive means imparting to the second conveyor a second substantially constant speed; and the first drive means imparting to the first conveyor a first speed ranging between a first value differing from that of said second speed, and a second value equal to that of said second speed.

The first drive means are preferably controlled by synchronizing means for detecting the difference in timing of equally spaced reference marks on the first and second strip material.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
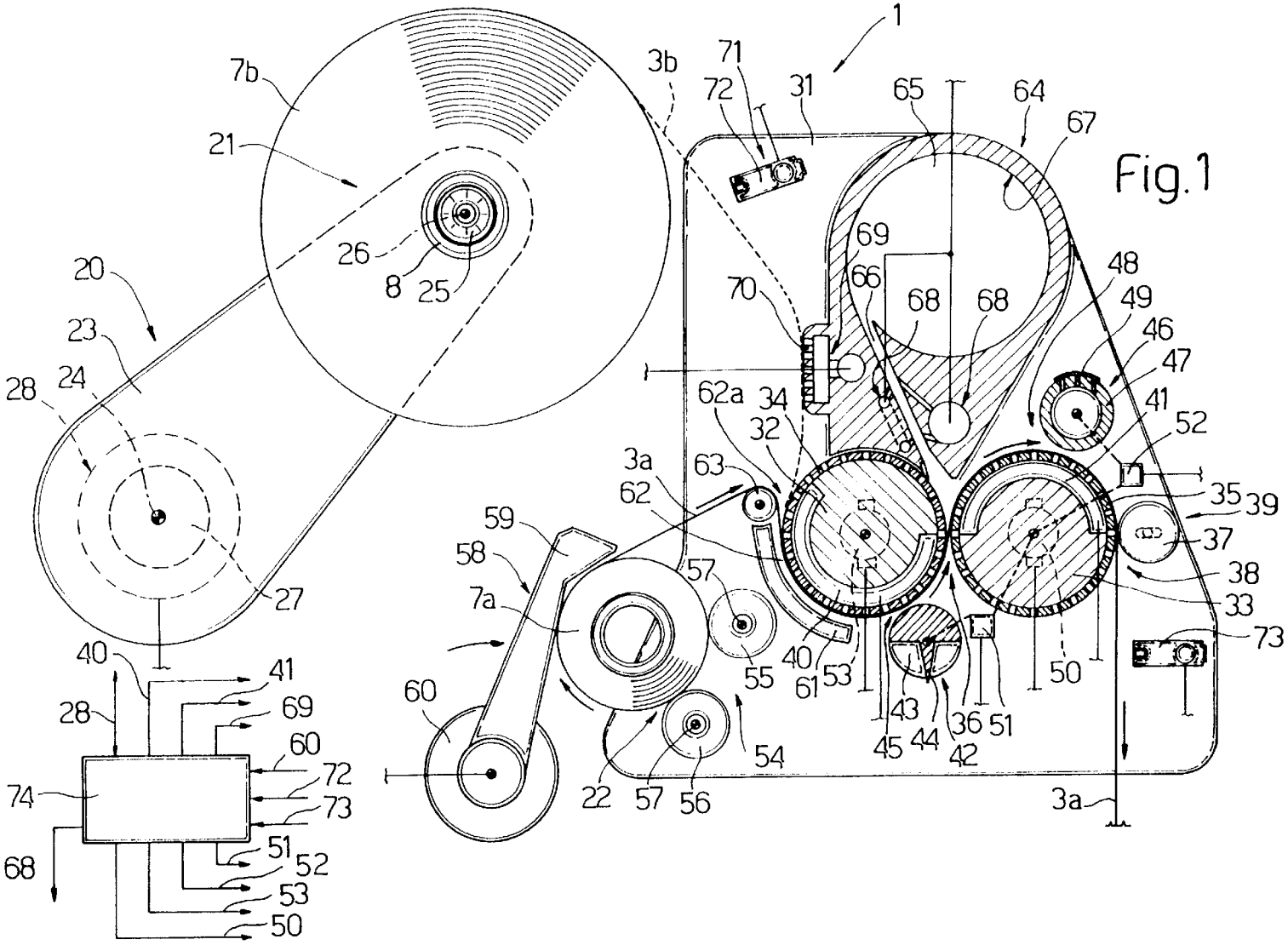
FIG. 1 shows a partially sectioned side view, with parts removed for clarity, of a preferred embodiment of a reel change device in accordance with the present invention and in a particular operating condition.
Figure 2:
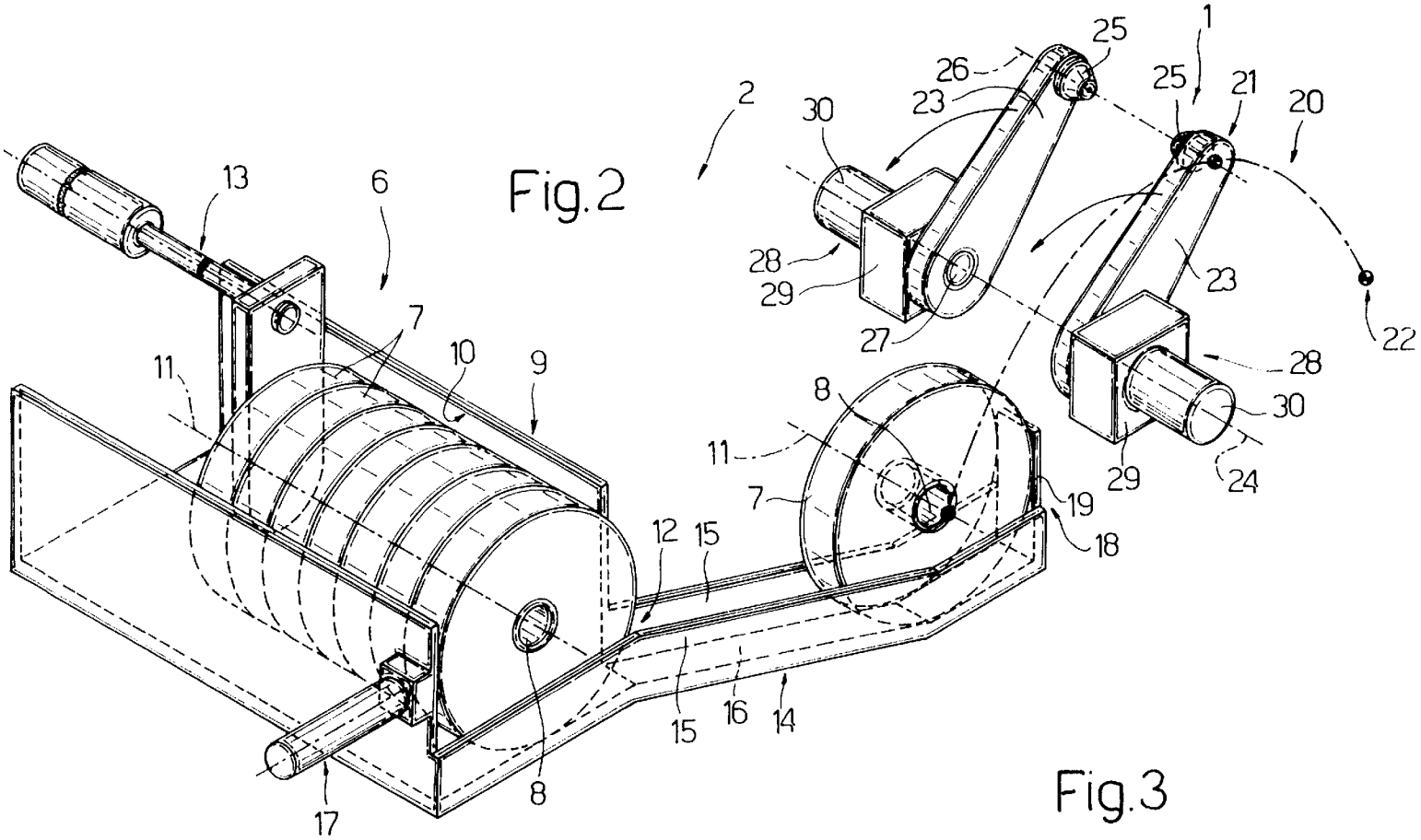
FIG. 2 shows a view in perspective of the input portion of a strip feed device featuring the FIG. 1 device.
Figure 3:
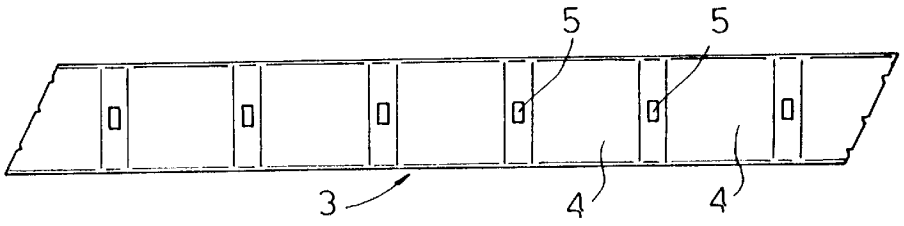
FIG. 3 shows a plan view of the strip material supplied by the device in FIGS. 1 and 2.

Number 1 in FIGS. 1 and 2 indicates a reel change device for a device 2 supplying a machine (not shown) with a strip 3 of sheet material comprising (FIG. 3) a succession of segments 4, and presenting a succession of markers 5, each located between two adjacent segments 4.

As shown in FIG. 2, in addition to device 1, device 2 also comprises an input portion 6 for successively supplying device 1 with reels 7 having a central core 8 about which strip 3 is wound.

Portion 6 comprises a store 9 in turn comprising a channel 10 with a substantially U-shaped cross section, for housing a number of substantially coaxial reels 7 arranged side by side on edge, with their respective axes 11 parallel to the longitudinal axis of channel 10. Reels 7 inside channel 10 are fed successively to the output 12 of the channel by a push device 13 movable back and forth in a direction parallel to the longitudinal axis of channel 10.

Store 9 also comprises a further channel 14 extending perpendicular to channel 10 from output 12, and defined by two lateral walls 15 separated by a distance approximately equal to but no less than the width of reels 7, and by a bottom wall 16 sloping downwards from output 12. Channel 14 presents a known push device 17 movable back and forth in a direction perpendicular to the longitudinal axis of channel 10, and which provides for successively engaging the periphery of reels 7, and successively rolling them between walls 15 and along wall 16 to a loading station 18 where each reel 7 is arrested on edge contacting a transverse stop wall 19 and resting on the upper surface of wall 16.

Feed device 2 also comprises a device 20 for successively transferring reels 7 from station 18 of input portion 6 to a first-unwinding station 21 and subsequently to a second-unwinding station 22, both associated with reel change device 1.

Device 20 constitutes the input portion of device 1, and comprises a pair of transfer arms 23 mounted for rotation at one end about a common transverse axis 24 parallel to axes 11 of reels 7. Each arm 23 presents a respective known truncated-cone-shaped engaging device 25, hereinafter referred to as a "coupling", projecting from the free end portion of arm 23 opposite axis 24, and which provides for engaging a respective end of core 8. Arms 23 are secured angularly to each other in known manner (not shown), so as to rotate together about axis 24 and remain facing each other, with couplings 25 coaxial at all times along a common axis 26 parallel to axis 24.

At the opposite end to that fitted with coupling 25, each arm 23 is fitted to the end of a respective shaft 27 coaxial with axis 24 and constituting the output shaft of an actuating unit 28 comprising a first reversible actuator 29 for rotating respective shaft 27 about axis 24, and a second linear actuator 30 for moving respective shaft 27 axially along axis 24 between a withdrawn position (FIG. 2) wherein the free ends of couplings 25 are separated by a distance greater than the length of cores 8, and an extracted position (not shown) wherein arms 23 are separated by a distance approximately equal to but no less than the length of cores 8.

As shown in FIG. 1, in addition to device 20, device 1 also comprises a vertical, substantially trapezoidal frame or plate 31 centrally supporting two cylindrical pneumatic distributors 32 and 33 to which are fitted for rotation respective tubular rollers 34 and 35 having substantially horizontal axes perpendicular to the FIG. 1 plane, and which are perforated and located tangent to each other at a transfer station 36. Roller 35 is located tangent to a pressure roller 37 at an output station 38 coplanar with the axes of rollers 34, 35 and with station 36, and constitutes, together with roller 37, a traction unit 39 for strip 3.

At the bottom, distributor 32 presents a suction chamber 40 extending about an arc of over 180° from station 36; and, at the top, distributor 33 presents a suction chamber 41 extending about an arc of substantially 180° between stations 36 and 38. Beneath roller 34, there is provided a cutting unit 42 comprising a roller 43 parallel and substantially tangent to roller 34, and in turn comprising a blade 44 which, when roller 43 is rotated clockwise (in FIG. 1), contacts the outer surface of roller 34 at a cutting station 45 facing an intermediate portion of chamber 40.

Over roller 35, there is provided a feed unit 46 comprising a suction roller 47 parallel and substantially tangent to roller 35, and which, when rotated anticlockwise (in FIG. 1), deposits on to the outer surface of roller 35, at a splicing station 48 facing an intermediate portion of chamber 41, a gummed band 49 fed in known manner on to roller 47 by a known feed device (not shown).

Roller 35 is rotated clockwise (in FIG. 1) at a substantially constant surface speed V1 by a motor 50 which, by means of respective clutch and reduction units 51 and 52, operates both roller 43 and roller 47 at surface speed V1. Roller 34, on the other hand, is rotated by a motor 53 anticlockwise (in FIG. 1) at a surface speed V2 ranging between two values respectively below and equal to the value of speed V1.

Roller 35 is fitted to plate 31 on the opposite side of roller 34 in relation to transfer device 20 and a device 54 for supporting reel 7 in second-unwinding station 22. Device 54 is located slightly below roller 34, and comprises two rollers 55 and 56, the second located below the first at a distance of less than the diameter of core 8, and each fitted idly to a respective horizontal shaft 57 parallel to the axes of rollers 34 and 35. Device 54 also comprises a known detecting device 58 for maintaining reel 7 in station 22 and determining its diameter, and in turn comprising a saddle lever 59 facing rollers 55 and 56, fitted to the horizontal output shaft of an angle measuring device 60, and rotating with said shaft and by virtue of a spring (not shown) towards rollers 55 and 56, for maintaining reel 7 in station 22 with its outer periphery contacting the periphery of rollers 55 and 56.

A plate 61, fixed to plate 31 between rollers 55 and 34, defines a channel 62 about the periphery of roller 34 and facing a portion of chamber 40 upstream from cutting station 45 in the rotation direction of roller 34. The output end of channel 62 faces the periphery of roller 43; and the input end is located at an input station 62*a*, and is defined laterally by a guide roller 63 fitted idly to a respective horizontal shaft fitted to plate 31, and located over plate 61 and roller 55.

Over roller 34, plate 31 supports a box 64, the bottom outer surface of which is substantially tangent to the portion of the periphery of roller 34 extending between transfer station 36 and the input end of channel 62. Box 64 defines a substantially cylindrical cavity 65 closed at the rear by plate 31, open at the front, and having a horizontal axis parallel to roller 34. Cavity 65 presents a lateral input channel 66 extending upwards from station 36 and substantially tangent to the cylindrical inner surface 67 of cavity 65, and to the periphery of roller 34 at station 36. Box 64 houses a number of blowing devices 68 terminating inside channel 66, and which provide for feeding pressurized air along channel 66 into cavity 65.

Box 64 also houses a suction or stop device 69 communicating externally through a perforated wall 70 over the input end of channel 62 and facing transfer device 20.

Plate 31 also supports a synchronizing device 71 comprising a first sensor 72 over stop device 69 and facing first-unwinding station 21; and a second sensor 73 downstream from output station 38.

The signals emitted by measuring device 60, by sensors 72 and 73, and by other sensors (not shown) for detecting the presence or absence of a reel 7 in various positions along input portion 6, are supplied to the inputs of a known control system 74 for controlling operation of push devices 13, 17, actuating unit 28, motors 50, 53, clutch units 51, 52, and devices 68, 69, according to a given program easily deducible from the following operating description of device 2.

Figure 6:
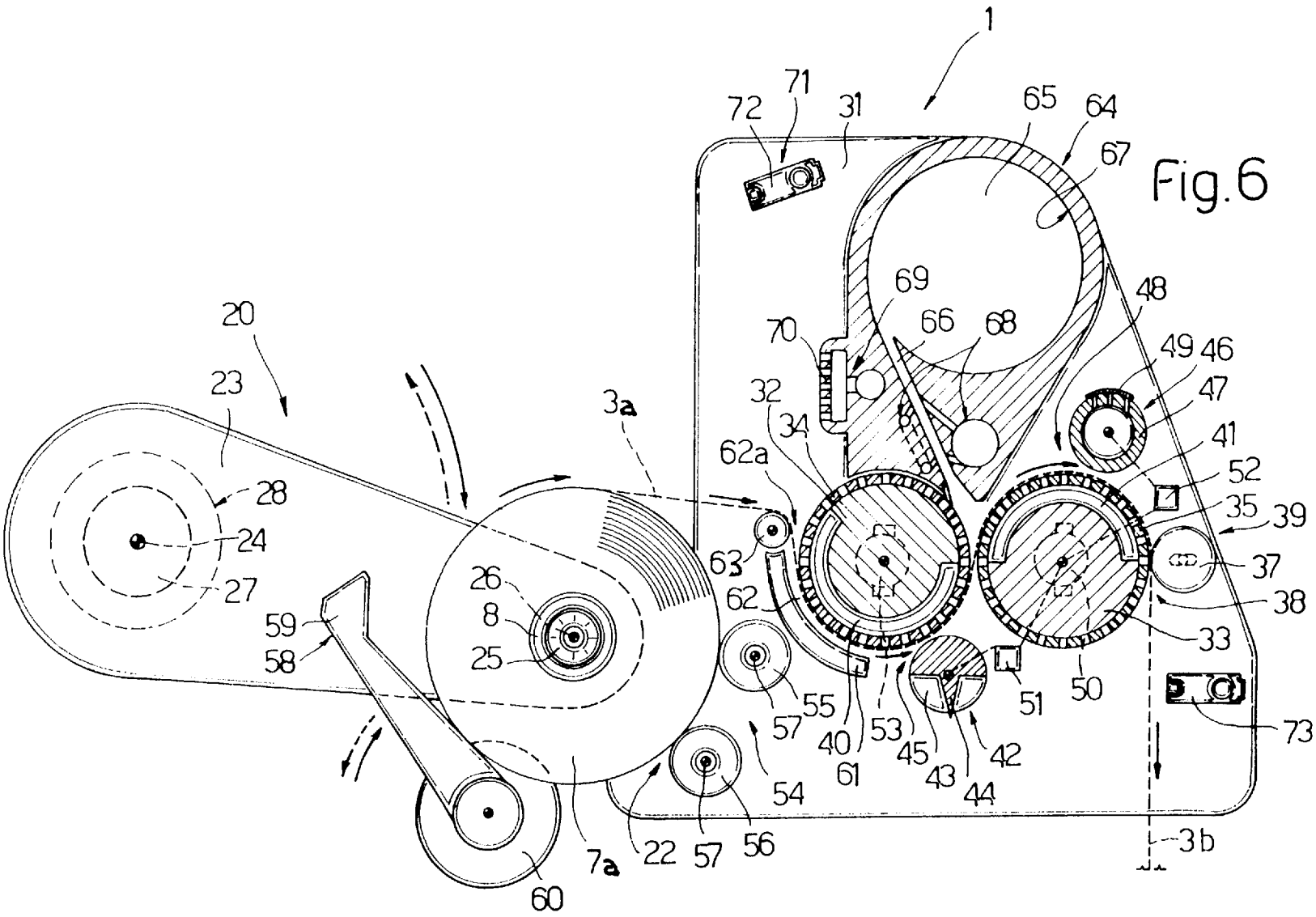

Operation of feed device 2 and, more specifically, of reel change device 1 will be described as of the condition in which device 20 has just released a reel 7 (hereinafter referred to as reel 7*a*) in second-unwinding station 22 (FIG. 6), and is returning empty (FIG. 2) to loading station 18 through first-unwinding station 21. In the above condition, reel 7*a* rotates about its axis 11 and in contact with lever 59 and the periphery of rollers 55 and 56; and respective strip 3 (hereinafter referred to as strip 3*a*) is fed about roller 63, through input station 62*a* into channel 62, about the bottom portion of roller 34, through station 36, about the top portion of roller 35, through traction unit 39, and out through output station 38. The required traveling speed V1 of strip 3*a* is ensured by motor 50 activating traction unit 39, while suction device 69 and the suction devices connected to chambers 40 and 41 are idle, and roller 34 rotates idly about distributor 32.

As of the above condition, control system 74 activates actuating units 28 to rotate arms 23 anticlockwise (in FIG. 2) and move axis 26 into station 18 so that it is substantially aligned with axis 11 of a reel 7 previously fed into station 18 by push devices 13 and 17; and actuators 30 are operated to bring arms 23 together and so engage couplings 25 inside the opposite ends of core 8 of reel 7, which may then be lifted out of station 18 and fed to first-unwinding station 21 by rotating arms 23 clockwise (in FIG. 2) about axis 24.

At this point, the new reel 7 in station 21 (hereinafter referred to as reel 7*b*) is still closed, and is opened either manually or by means of a known automatic opening device (not shown), so as to partly unwind (FIG. 1) respective strip 3 (hereinafter referred to as strip 3*b*) and position the free end at input station 62*a*. As it is being partly unwound, strip 3*b* is fed past sensor 72 which, by means of control system 74, activates device 69 to draw in strip 3*b* by suction and retain it in the initial hold position described above.

Figure 4:
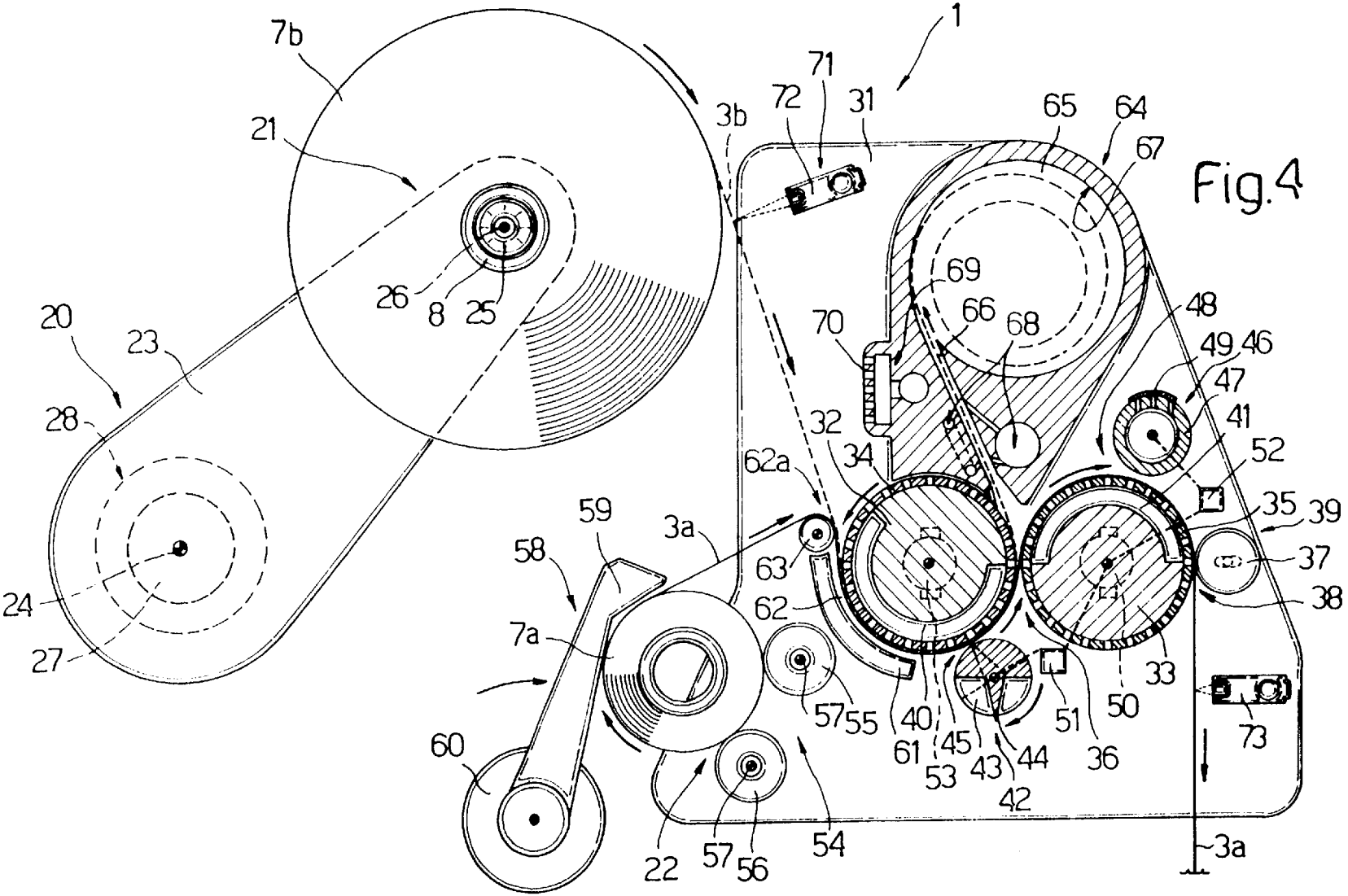
FIGS. 4 to 6 are similar to FIG. 1, and show the FIG. 1 reel change device in a further three operating conditions.

As strip 3*a* is consumed, reel 7*a* gets gradually smaller so that lever 59 rotates (clockwise in FIG. 1) about the axis of device 60 and towards rollers 55 and 56. Upon the diameter of reel 7*a* falling below a given value, device 60 emits a signal which, by means of control system 74, activates the suction device connected to chamber 40, and at the same time deactivates device 69 so that the end of strip 3*b* adheres to roller 34. Strip 3*b* (FIG. 4), which is inserted between strip 3*a* and the periphery of roller 34, is fed by roller 34 through input station 62*a*, along channel 62, and through station 36 to channel 66 along which it is fed by devices 68 into cavity 65 where it begins winding.

In connection with the above, it should be pointed out that the suction through chamber 40 in no way affects strip 3*a* which is completely shielded by strip 3*b* contacting the outer surface portion of roller 34 along which chamber 40 extends.

Upon strip 3*b* reaching cavity 65, control system 74 activates both motor 53, to rotate roller 34 at a surface speed V2 lower than speed V1, and synchronizing device 71 which, by means of sensors 72 and 73, detects the difference in timing of markers 5 of strips 3*a* and 3*b*. As strips 3*a* and 3*b* are fed in the same direction at different speeds V1 and V2 imparted respectively by traction unit 39 and motor 53, the difference in timing of markers 5 of strips 3*a* and 3*b* varies continuously until it is eventually eliminated. When this occurs, device 71, by means of control system 74, accelerates motor 53 to rotate roller 34 at surface speed V1 so that strips 3*a* and 3*b* are fed forward in time with each other.

Figure 5:
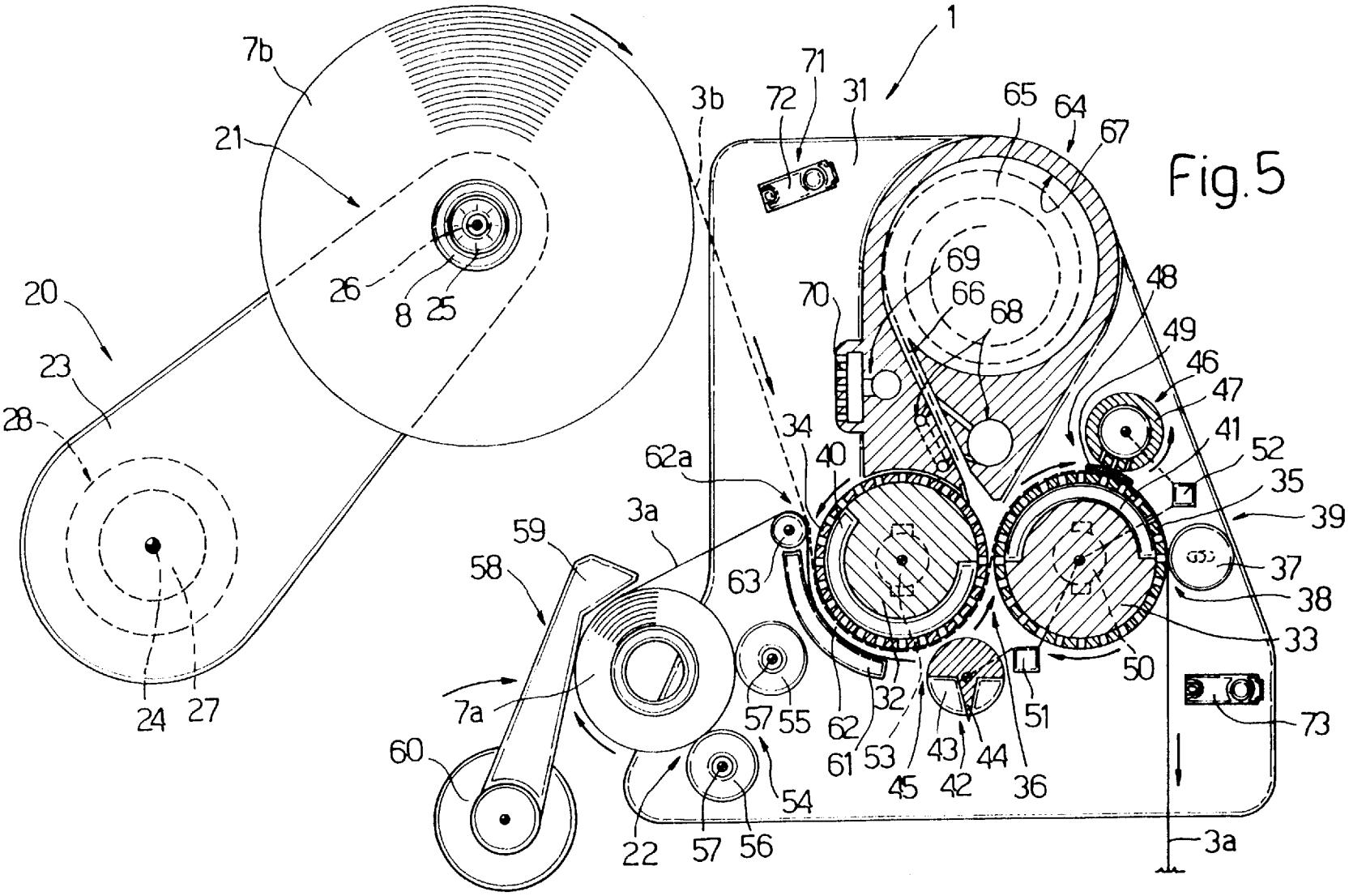

At this point (FIG. 5), control system 74, by means of unit 51, activates roller 43 to cut strips 3*a* and 3*b* simultaneously at cutting station 45, and at the same time activates the suction through chamber 41.

As a result of the above two operations, the rear portion of strip 3*a* connected to reel 7*a* drops down off roller 34, while reel 7*a* is arrested by no longer being connected to traction unit 39; and the front portion of strip 3*b*, shielded by strip 3*a* from the suction through chamber 41, is shot by roller 34 into cavity 65 from which it is removed either manually or automatically by means of a pneumatic device. The front portion of strip 3*a*, on the other hand, continues traveling at speed V1 and is held contacting the outer surface of roller 35 by the suction through chamber 41; while the rear portion of strip 3*b*, with its leading end contacting, end to end, the trailing end of the front portion of strip 3*a*, and by virtue of the suction through chamber 40, travels at speed V1 to transfer station 36 where strip 3*b* is transferred on to roller 35 by virtue of the suction through chamber 41.

As the trailing end of strip 3*a* and the leading end of strip 3*b*, facing and contacting each other, travel at speed V1 through splicing station 48, control system 74 activates roller 47 by means of unit 52 to apply gummed band 49 (FIG. 5) to the facing ends of strips 3*a* and 3*b* and so join them end to end. At this point, the suction through chambers 40 and 41 is cut off; reel 7*a* is unloaded by rotating lever 59 anticlockwise; and strip 3*b* is unwound normally by traction unit 39 off reel 7*b* in first-unwinding station 21. After a certain length of time, upon the diameter of reel 3*b* being reduced by a given amount, transfer device 20 is activated to transfer reel 7*b* to second-unwinding station 22, and then return empty to loading station 18.

The advantages of reel change device 1 according to the present invention are as follows. In particular, it provides for straightforward, relatively low-cost automation of the entire operation; for end to end splicing two strips without stopping the strips and, hence, with no need for cumbersome takeup stores for the strip in use; for synchronizing both the speed and timing of the two strips prior to splicing; and, when synchronizing the two strips, for eliminating one or more normally damaged outer turns of the new reel prior to splicing the strip to that of the runout reel.

I claim:

1. A reel change device (1) for feed devices (2) supplying strip material (3) to a user machine; the reel change device (1) comprising a first (21) and second (22) unwinding station for a first (7*b*) and second (7*a*) reel of respectively first (3*b*) and second (3*a*) strip material; said first strip material (36) having a free end: strip guide means (34,35) for guiding the strip material and defining a path along which the strip material (3) is fed in a given unwinding direction; and cutting means (42) and splicing means (46) located along said path, for cutting and splicing the strip material (3); the strip guide means comprising a first (34) and second (35) conveyor in series with each other, the first conveyor upstream from the second conveyor in said unwinding direction, and closely adjacent to each other at a transfer station (36) at which the strip material (3) is transferred from the first (34) to the second (35) conveyor, the conveyors (34, 35) respectively defining substantial first and second contiguous portions of said path, and being arranged on opposite sides of said path; strip material disposing means (64) at the transfer station (36); and first (40) and second (41) selectively-activated retaining means respectively extending along said first and second path portions, for respectively retaining the strip material (3) on the first (34) and second (35) conveyor; the cutting means (42) being located along said path at a cutting station along the first (34) conveyor, the splicing means being located along said path at a splicing station along the second (35) conveyor; said disposing means (64) comprising a cavity (65) for receiving said first strip material (3*b*), a disposal channel (66) extending from said transfer station (36) and communicating with said cavity (65), the disposal channel being substantially tangent to the first portion of the path at the transfer station (36) and extending on the same side as the first portion in relation to the second portion of said path, and pneumatic advancement means (68) for force feeding said first strip material (3*b*) forwards along said disposal channel (66) and into said cavity (65): said path being shaped to enable the free end of said first strip material (3*b*) to be fed, in use, to said disposal channel (66) by passing between the first retaining means (40) and the second strip material (3*a*).

2. A device as claimed in claim 1, wherein the first and second retaining means (40, 41) are suction retaining means; the first (34) and second (35) conveyors being permeable to air.

3. A device as claimed in claim 1, wherein said first and second portions of said path respectively extend beneath the first conveyor (34) and over the second conveyor (35).

4. A device as claimed in claim 1, wherein the first (34) and second (35) conveyors respectively comprise a first (34) and second (35) suction roller substantially tangent to each other at said transfer station (36).

5. A device as claimed in claim 1, further comprising first (53) and second (50) drive means for said first (34) and second (35) conveyors; the second drive means (50) imparting a second substantially constant speed (V1) to the second conveyor (35); and the first drive means (53) imparting to the first conveyor (34) a first speed (V2) ranging between a first value other than that of said second speed (V1), and a second value equal to that of said second speed (V1).

6. A device as claimed in claim 5, further comprising a synchronizing means (71) for controlling said first drive means (53); said synchronizing means (71) detecting a difference in timing of reference marks (5) equally spaced along the first **(3*b*) and second (3*a*)** strip material.

7. A device as claimed in claim 1, further comprising means (55, 56, 59) for supporting said reel (7) in said second unwinding station (22); and means (20) for transferring said reel (7) from the first (21) to the second (22) unwinding station.

8. A reel change device for supplying strip material to a user machine, the reel change device comprising:

a) a first and second unwinding station for use in unwinding a first and second reel of respectively first and second strip material;

b) conveyor means for conveying the second strip material in an unwinding direction along an unwinding path comprising first and second contiguous portions and for concurrently conveying the first strip material along the first portion of the unwinding path, with the first strip material in overlapping relation to the second strip material, without conveying the first strip material along the second portion of the unwinding path when the first and second strip material are in said overlapping relation, said conveyor means comprising first and second conveyors and a transfer station at which at least the second strip material is transferred from the first conveyor to the second conveyor, the first and second conveyors being disposed in series with respect to one another with the first conveyor upstream from the second conveyor in said unwinding direction and being disposed on opposite sides of said unwinding path, said first conveyor defining at least a part of said first contiguous portion of the unwinding path and said second conveyor defining at least a part of said second contiguous portion of the unwinding path, the first and second conveyors being closely adjacent to one another at the transfer station;

c) cutting means located at a cutting station along said first portion of the path for cutting the first and second strip material and for thereby forming along said first portion of the path a disposable first strip and a sliceable first strip from the first strip material and a disposable second strip and a sliceable second strip from the second strip material; said conveyor means including traction means for conveying the sliceable second strip cut by the cutting means to the transfer station and along the second portion of the path without also conveying the disposable first strip to the transfer station or along the second path portion;

d) disposal means for removing the disposable first strip cut by said cutting means from said unwinding path; said disposal means comprising a cavity for receiving said first strip material, a disposal channel extending from said transfer station and communicating with said cavity, the disposal channel being substantially tangent to the first portion of the path at the transfer station and extending on the same side as the first portion in relation to the second portion of said path, and pneumatic advancement means for force feeding said first strip material forwards along said disposal channel and into said cavity; said disposal means being disposed relative to said path such that a free end of said first strip material to be disposed passes to said disposal channel between the first retaining means and the second strip material.

e) first retaining means along the first portion of the path for retaining said sliceable first strip on said first conveyor whereby said first conveyor can convey the sliceable first strip to the transfer station after the first strip material has been cut;

f) second retaining means along said second portion of the path for drawing the sliceable first strip from said transfer station to said second conveyor only after a trail end of the sliceable second strip is conveyed past the transfer station whereby the sliceable first strip and the sliceable second strip do not overlap on the second conveyor, and for retaining said first and second sliceable strips on said second conveyor without overlap; and g) splicing means located at a splicing station along said second portion of the path for joining said sliceable first and second strips along the second conveyor.

9. A reel change device according to claim 8 further comprising control system means for selectively activating said cutting means, disposal means, and first and second retaining means and for synchronizing a relative speed of said first and second conveyors so as to cause said first and second spliceable strips to be transferred to said second conveyor in end-to-end relationship for splicing.

* * * * *